US009283770B2

(12) United States Patent
Kirchner

(10) Patent No.: US 9,283,770 B2
(45) Date of Patent: Mar. 15, 2016

(54) APPARATUS FOR THERMAL PRINTING OR EMBOSSING

(71) Applicant: ILLINOIS TOOL WORKS INC., Glenview, IL (US)

(72) Inventor: Harald Kirchner, Margetshochheim (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 14/412,244

(22) PCT Filed: Jul. 9, 2013

(86) PCT No.: PCT/US2013/049754

§ 371 (c)(1),
(2) Date: Dec. 31, 2014

(87) PCT Pub. No.: WO2014/011654

PCT Pub. Date: Jan. 16, 2014

(65) Prior Publication Data

US 2015/0174913 A1 Jun. 25, 2015

(30) Foreign Application Priority Data

Jul. 9, 2012 (DE) ..... 10 2012 013 487

(51) Int. Cl.

| | |
|---|---|
| ***B41J 2/325*** | (2006.01) |
| ***B41J 17/38*** | (2006.01) |
| ***B41J 35/38*** | (2006.01) |
| ***B41J 3/38*** | (2006.01) |

(52) U.S. Cl.

CPC .. *B41J 2/325* (2013.01); *B41J 3/38* (2013.01); *B41J 17/38* (2013.01); *B41J 35/38* (2013.01); *B41J 2202/38* (2013.01)

(58) Field of Classification Search

USPC ..... 347/171, 176, 177, 212, 213, 178; 400/120.01, 120.18

See application file for complete search history.

(56) References Cited

U.S. PATENT DOCUMENTS 3,614,430 A * 10/1971 Berler ..... 250/271
4,819,083 A * 4/1989 Kawai et al. ..... 358/451

(Continued)

FOREIGN PATENT DOCUMENTS

| | | | |
|---|---|---|---|
| JP | 6019542 | A | 1/1985 |
| JP | 63197669 | A | 8/1988 |
| JP | 2008272971 | A | 11/2008 |

OTHER PUBLICATIONS

ISR and WO for PCT/US2013/049754 mailed Nov. 15, 2013.

*Primary Examiner* — Anh T. N. Vo
(74) *Attorney, Agent, or Firm* — Hauptman Ham, LLP

(57) ABSTRACT

The invention relates to an apparatus for thermal printing or embossing, comprising a film conveying section for a carrier film coated with a coloring agent, a print support for a printable medium and a printhead for selectively heating the carrier film in accordance with a predetermined printed image, so that the coloring agent is transferred from the carrier film to the printable medium in accordance with the predetermined printed image. The apparatus is characterized in that it further comprises a sensor device set up for recording a remaining pattern of the coloring agent on the carrier film after the heating of the carrier film and set up for generating a sensor signal on the basis of the recorded pattern. The invention additionally relates to a corresponding process for printed image inspection in thermal printing or embossing and to a computer program with program code for carrying out the process when the computer program is performed in a computer.

18 Claims, 1 Drawing Sheet

(56) References Cited

U.S. PATENT DOCUMENTS 5,212,558 A * 5/1993 Obata et al. ..... 358/296
5,354,134 A 10/1994 Patry
5,471,235 A 11/1995 Patry
5,990,918 A * 11/1999 Baxendale ..... 347/212
6,947,168 B2 * 9/2005 Fujimoto et al. ..... 358/1.18
2007/0035597 A1 2/2007 Ready et al.
2011/0074904 A1 3/2011 Marcus et al.

* cited by examiner

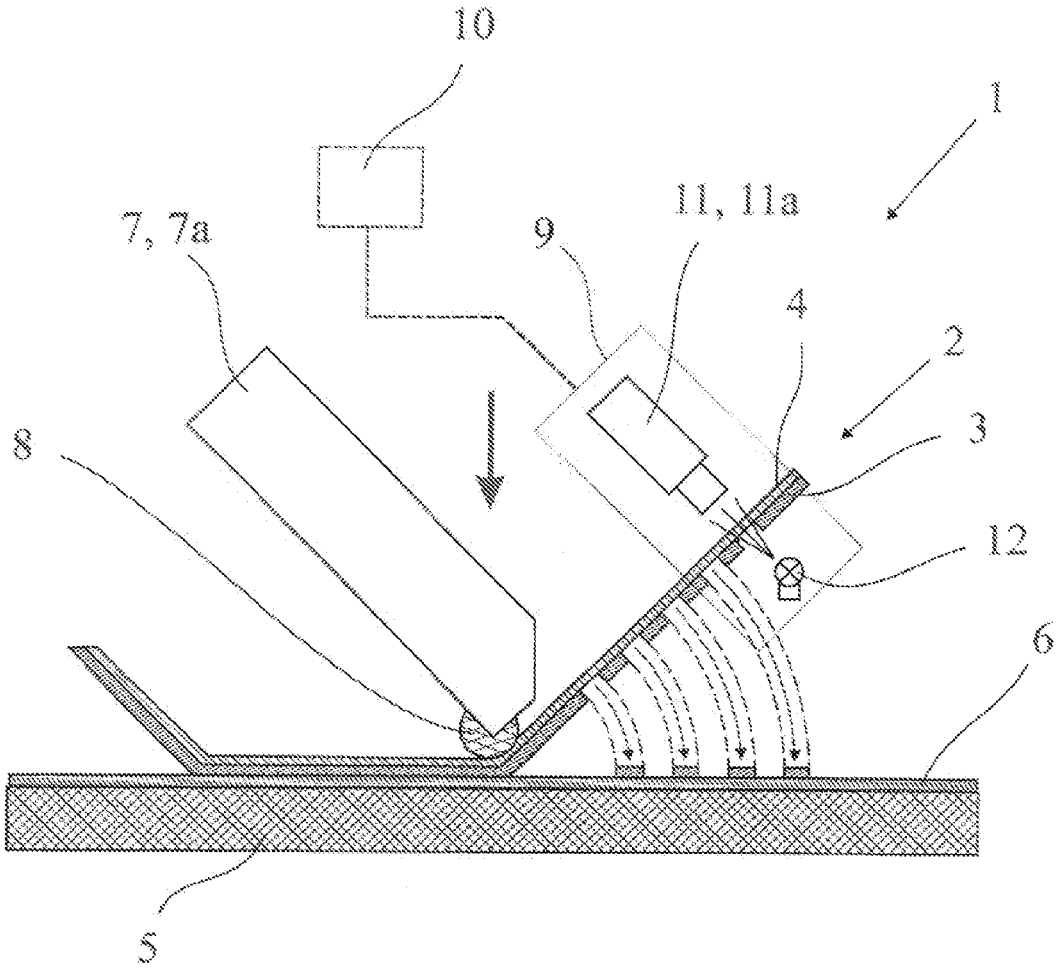
10
1
11, 11a
7, 7a
9
4
2
3
8
12
6
5

APPARATUS FOR THERMAL PRINTING OR EMBOSSING

RELATED APPLICATIONS

The present application is a National Phase of International Application Number PCT/US2013/049754 filed Jul. 9, 2013, and claims priority to German Application Number 10 2012 013 487.8 filed Jul. 9, 2012.

The invention relates to an apparatus for thermal printing or embossing with the features of the preamble of claim 1, to a process for printed image inspection in thermal printing or embossing with the features of the preamble of claim 15 and also to a computer program with program code with the features of claim 18.

Two known printing processes are thermal transfer printing and thermal sublimation printing. These two printing processes are based on the basic principle that a carrier film coated with coloring agents is brought up to the medium to be printed and is heated by means of a thermal printhead. This thermal printhead has a multiplicity of heating elements, which can be individually heated and represent individual picture elements—that is to say pixels—for this printing process. A heated heating element has the effect that the coloring agent at the corresponding point of the carrier film dissolves and is taken up by the medium to be printed, where it in turn solidifies. In other words, during the printing operation, ink particles are dissolved in sections from the ribbon and transferred to the object to be printed.

The detachment of the coloring agent is brought about in thermal transfer printing by the coloring agent being melted, whereas in thermal sublimation printing the coloring agent is transformed into a gaseous state. Thus, by the controlled heating of the heating elements and detachment of the coloring agents from the carrier film, any desired pattern or image can be created on the medium to be printed.

A further known process provides that a carrier film coated with coloring agents in the way described is in turn brought up to the medium to be printed, but this time is heated by means of a die-like block, on which a contour corresponding to the desired printed image is structured in a fixed state. Although the entire die is heated here, the carrier film is only contacted by it at the contoured points, as a result of which the transfer of the ink particles from the ribbon to the medium to be printed only occurs at these points. This process is also referred to as a hot embossing process and corresponds in its ink transfer mechanism to thermal transfer printing and thermal sublimation printing, with the only difference being that the contour to be printed is predetermined by the forming of the die.

In the context of this invention, the term thermal printing consequently always means equally the processes of thermal transfer printing, thermal sublimation printing and the hot embossing process. It does not mean direct thermal printing, in which the medium to be printed is itself heat-sensitive and is heated directly. It correspondingly applies that the term thermal printing process likewise means the thermal transfer printing process, the thermal sublimation printing process and the hot embossing process.

These three mentioned thermal printing processes are known for offering a high level of printing quality and good durability. Especially thermal transfer printing, for example, is regularly used for printing labels in packaging systems.

In some applications, for example in thermal transfer printing in the pharmaceuticals industry, and there as part of consignment tracking (Track & Trace), an inspection of the correct printing result is important. This conventionally takes place by a camera continuously recording the printed medium that comes from the thermal transfer printer and comparing the recorded pattern on the printed medium with the corresponding image data transmitted to the printer. A deviation between the desired pattern and the actual pattern consequently means that there is a defective print.

However, this type of print inspection has several disadvantages. Firstly, it requires a camera and an image detection system, which are both arranged outside the actual thermal transfer printer. Furthermore, the image signal, which defines the desired pattern to be printed and is always located inside the thermal transfer printer, must be passed to the external image detection system. Furthermore, depending on the color contrast between the medium to be printed and the printing ink, the image detection may be made more difficult and, in particular, react sensitively to changes of one or the other color during printing operation.

A readjustment between the image detection system and the thermal transfer printer may also be necessary for instance whenever there is for instance a change to a new character set during printing operation.

The invention is explained below on the basis of a thermal transfer printer. However, the statements made in this respect equally apply to thermal sublimation printing and the hot embossing process.

The crucial factor is the finding that the carrier film itself after the printing operation is better suited than the printed medium for a printed image inspection. This is so because, in thermal printing, the coloring agent disappears precisely at those points of the carrier film at which it has been transferred to the printable medium by heating the heating elements of the thermal printhead or of the block. In thermal sublimation printing, although the coloring agent does not necessarily disappear completely from the heated point, it does fade noticeably, and does so all the more the fuller the desired color depth is at the point concerned on the medium to be printed.

Since a transparent carrier film is left behind at the point at which ink particles have been removed from the ribbon, the carrier film after the printing operation in this way offers a negative of the pattern that is actually printed. Specifically because of this transparency of the carrier film, this negative also has a very great contrast.

According to the proposal, the apparatus for thermal printing or embossing accordingly has a sensor device, which can record the pattern on the carrier film after the printing operation and on this basis generates a signal. Equally, the process according to the proposal comprises specifically these steps. Therefore, the proposal concerns an indirect printed image inspection, since it is not the actual printed object but only the carrier film used for it that is investigated. This makes possible for instance a genuine pixel inspection of the printhead that detects not only electrical but also mechanical damage. At the same time, the evaluation electronics can be of a simpler and lower-cost configuration.

Performing the printed image inspection within the apparatus for thermal printing or embossing makes possible a compact and low-cost arrangement of the inspection device within this apparatus. Such an integrated apparatus for thermal printing or embossing and inspection can be accommodated in an encapsulated housing. This makes a stable and protected industrial design possible.

Furthermore, the investigation of the carrier film offers contrast conditions that are always constant, irrespective of what kind of background color the printed object has. Using the pattern on the carrier film for assessing the printing quality allows changes to the product after printing not to influence the result of this check. In the case of bags to be printed and a check on the printed object, there could arise for instance a situation in which these bags are deformed at the printed point during the further processing by the packaging installation. This would make direct recording of the printed pattern more difficult. However, the carrier film itself would of course not be affected by such a situation.

In accordance with an exemplary embodiment, there is an apparatus as detailed herein, characterized in that the logic unit (10) is set up for the purpose of generating a defect detection signal on the basis of a comparison of the sensor signal and the printed image signal. Still further, in an exemplary embodiment, there is an apparatus as detailed herein, characterized in that the logic unit (10) is set up for the purpose of generating a defect detection signal that corresponds to a detected defect when the pattern of the coloring agent (3) recorded by the sensor device (9), w hich pattern corresponds to the sensor signal, deviates from a negative of a printed image, which corresponds to the printed image signal. In an exemplary embodiment, with respect to the aforementioned apparatus just described in this paragraph, apart from the recording of the color pattern on the carrier film after the printing operation, a comparison between the recorded image pattern—also referred to as the live image—and the image pattern desired according to the printed image signal—also referred to as the print order—and a corresponding evaluation may take place in the same processing unit, and consequently likewise within the apparatus itself.

Since the printed image signal must in any case be located within the apparatus for the printing operation itself, it can consequently also be used at the same time within the apparatus for the inspection. This dispenses with the necessity for the signal to be brought out to an external unit and for possible synchronization, and also obviates the risk of transmission problems in this data communication. The fact that the checking of the carrier film can also take place directly after the printing operation and that it is not necessary for instance to wait until the object to be checked has been transported further over a certain distance means that it is also possible for the inspection of the printed image to be almost in real time.

In an exemplary embodiment, there is an apparatus as detailed herein, characterized in that the logic unit (10) is set up for the purpose of detecting on the basis of the sensor signal portions on the carrier film (4) on which the coloring agent (3) has remained completely and generating a corresponding print spacing signal. In an exemplary embodiment, this apparatus can be considered to describe an exemplary embodiment in which the recorded image data are checked not only for instance with regard to their conformity with the printed image signal but also checked for whether there are major portions of the carrier film with a completely preserved coloring agent layer. In such a case, a corresponding signal is generated and can be used for the purpose of using these portions for another printing operation.

In an exemplary embodiment, there is an apparatus as detailed herein, characterized in that the sensor device (9) comprises an image sensor (11) and preferably a light source (12) aligned in the direction of the intake sensor (11), the light source (12) being set up for the purpose of illuminating the carrier film (4) such that the remaining pattern of the coloring agent (3) on the carrier film (4) is recorded as a negative by the image sensor (11). This apparatus can be considered to be a particularly elegant way of recording the negative pattern on the carrier film, at least with respect to embodiments in which the carrier film is illuminated from its rear side. As a result, the points of the carrier film without coloring agent show up brightly, so that they can be clearly recorded by an image sensor from the other side, against the light as it were.

The invention is explained in more detail below on the basis of the drawing, which presents just one exemplary embodiment and in which:

FIG. 1 shows an apparatus according to the proposal for thermal printing or embossing in an entirely schematic representation.

The apparatus represented in the drawing for thermal printing or embossing may be both a completely independent device and a modular thermal printer, which as a module forms a component part of a larger machine, such as for instance of a packaging installation.

According to the invention, the apparatus 1 for thermal printing or embossing—which here by way of example, and with preference, is a thermal transfer printer—comprises a film conveying section 2 for a carrier film 4 coated with a coloring agent 3. The film conveying section refers to a structure, such as for example a channel or a system of deflecting rollers, that predetermines a run of the transfer film 4 through the thermal printer 1.

The carrier film 4 is a special type of film for the thermal printing process, which has taken up the coloring agent 3. Local heating of the carrier film 4 leads to a detachment of the coloring agent 3 specifically at the point that is heated. In thermal transfer printing, this takes place by liquefaction and in thermal sublimation printing it takes place by transformation into the gaseous state. At the point concerned of the carrier film 4 there then remains either no coloring agent 3 at all (thermal transfer printing) or a residue of coloring agent that is inversely proportional to the color depth used for the print (thermal sublimation printing). The same also applies correspondingly to the hot embossing process.

According to the invention, it is also provided that the apparatus 1 has a printing support 5 for a printable medium 6. The printing support 5 may be a simple baseplate or else a printing roller. Normal paper, or else label paper, come into consideration by way of example as the printable medium 6.

Furthermore, according to the invention the apparatus 1 has a printhead 7 for selectively heating the carrier film 4 in accordance with a predetermined printed image.

In addition, according to the invention the apparatus 1 has a sensor device 9, which is set up for recording a remaining pattern of the coloring agent 3 on the carrier film 4 after the heating of the carrier film 4 and is also set up for generating a sensor signal on the basis of the recorded pattern. Because in the processes that are the subject here, of thermal transfer printing, thermal sublimation printing and the hot embossing process, the prior heating at a specific point of the carrier film 4 leads to either complete removal or at least partial removal of the coloring agent at this very point, such a recording of the remaining pattern of the coloring agent 3 on the carrier film 4—therefore a negative of the printed image that is actually printed—and a correspondingly generated sensor signal provide indications as to whether, and at which points, a successful color transfer has taken place from the carrier film 4 to the medium 6 to be printed.

According to a particularly preferred embodiment, the printhead 7 is a block for hot embossing, the block corresponding to the predetermined printed image. The block in this sense is a die, which often consists of a metal such as brass, copper or magnesium and has a surface with a contour that reproduces the predetermined printed image. This unchanging contour, with respect to the respective block, then defines those points at which ink is transferred from the carrier film 4 to the medium 6 to be printed.

An alternative preferred embodiment is characterized in that the printhead 7 is a thermal printhead 7*a*, with heating elements 8 for selectively heating the carrier film 4 on the basis of a printed image signal, which corresponds to a predetermined printed image. This embodiment relates to apparatuses, both for the thermal transfer printing process and for the thermal sublimation printing process.

The heating elements 8 are regularly arranged in a series, which lies transversely in relation to the running direction of the film conveying section 2. The number of heating elements 8 thereby defines a resolution in the transverse direction of the carrier film 4. The resolution in the longitudinal direction—corresponding to the running direction of the carrier film 4 according to the film conveying section 2—is then determined by the increments in which the thermal printhead 7*a* is advanced in relation to the carrier film 4 between individual heating operations.

The printed image signal corresponds to a predetermined printed image, so that the coloring agent 3 is transferred from the carrier film 4 to the printable medium 6 in accordance with the predetermined printed image. The printed image signal may for instance define a bitmap and relate either to a specific heating configuration for an individual printing point in the longitudinal direction of the carrier film 4, or else to an entire longitudinal portion of the carrier film 4 with accordingly multiple printing points.

It is particularly preferred that the apparatus 1 comprises a logic unit 10 for detecting a defective print on the basis of the sensor signal. The logic unit 10 is preferably set up for detecting a defective print on the basis of the sensor signal and the printed image signal. The logic unit 10 may in this case provide any desired separate or joint processing of the sensor signal and the printed image signal, it being possible in principle for both signals to be both in analog form and in digital form. There is, in principle, a defect whenever the printed image corresponding to the printed image signal deviates from the printed image recorded by the sensor device.

Further advantages arise from the fact that this logic unit 10 is set up for the purpose of generating a defect detection signal on the basis of a comparison of the sensor signal and the printed image signal. The defect detection signal may be, for example, a binary indication of whether there is in the first place any defect corresponding to a lack of conformity between the printed image and the recorded pattern. This may in particular mean that a defect detection signal can only be generated in the first place when a defect has been positively detected. Alternatively, the defect detection signal may also indicate with any desired accuracy, such as for instance for each individual pixel point corresponding to an individual heating element 8, whether and to what extent there is conformity or not. The defect detection signal may be used for instance for the purpose of issuing a warning recognizable to the user or, if the apparatus according to the invention is used in a packaging machine, actuating a diverter within the packaging machine and thereby rejecting defectively printed objects.

It is also particularly preferred that the logic unit 10 is set up for the purpose of generating a defect detection signal that corresponds to a detected defect when the pattern of the coloring agent 3 recorded by the sensor device 9, which corresponds to the sensor signal, deviates from a negative of a printed image, which corresponds to the printed image signal.

However, the logic unit 10 can not only detect on this basis printing defects in the narrower sense—that is to say in particular minor deviations between the desired printed image and the actual pattern on the medium 6 to be printed—but can also detect other condition-related matters as well as further defect situations. It may for instance automatically detect the width of the loaded carrier film, any folding in the carrier film or else tearless pulling out of the ribbon from the thermal printer caused by sticking to the printed object.

An automatic correction of the activation of the heating elements 8 may also be realized with the aid of the logic unit 10. Conventionally, the heating elements 8 are always provided with the same heating voltage for heating when printing by the respective heating element 8 is intended to take place, and indeed not supplied with this heating voltage when the respective heating element 8 is not intended to print. Depending on the operating state and duration, the same heating voltage may however lead to a different temperature at the heating element 8, and consequently to a different printing result at the picture element concerned. The logic unit 10 may therefore also carry out a correction of the heating voltage at each heating element 8 on the basis of the sensor signal. If for instance a picture element is printed too large, this may indicate an increased temperature at a heating element 8, which in turn may lead to a corrected lowering of the heating voltage at this heating element 8. Conversely, if the print of a picture element covers too small an area, the correction may lead to an increase in the heating voltage at this heating element 8.

Particular possibilities arise if the logic unit 10 is set up for the purpose of detecting on the basis of the sensor signal portions on the carrier film 4 on which the coloring agent 3 has remained completely and generating a corresponding print spacing signal. This detection takes place on portions of the carrier film 4 on which the heating by the printhead 7 must have already taken place. In this way, print spacings can be detected and unused parts of the carrier film 4 with the corresponding coloring agents 3 can be re-used, for instance by the carrier film 4 being automatically rewound to these unused portions. Such an automatic ribbon saving system ensures more effective use of the ribbon.

It is also provided with preference that the logic unit 10 is set up for the purpose of determining on the basis of the sensor signal a running-through speed of the carrier film 4 and generating a corresponding speed signal. In this way, both the consumption of the carrier film 4 can be measured and the circumferential speed can be determined. This in turn can form the basis for regulating the speed of that drive that moves the carrier film 4 along the film conveying section 2.

In a particularly preferred embodiment of the invention, the sensor device 9 comprises an image sensor 11 and a light source 12 aligned in the direction of the image sensor 11, the light source 12 being set up for the purpose of illuminating the carrier film 4 such that the remaining pattern of the coloring agent 3 on the carrier film 4 is recorded as a negative by the image sensor 11. Such an arrangement is achieved for instance by the image sensor 11 being arranged on one side of the carrier film 4 such that its detection range is directed onto the carrier film 4, while the light source 12 is arranged on the other side of the carrier film 4, aligned opposed to and in the direction of this image sensor 11, to be precise such that, when there is a carrier film 4 with completely preserved coloring agent 3, no light passes from the light source 12 into the image sensor 11. Light from the light source 12 therefore only falls into the image sensor 11 when the coloring agent 3 has been removed at the corresponding points of the carrier film 4 during the heating of a corresponding heating element 8, and then only to the extent that it can be delimited on a pixel basis. The remaining pattern of the coloring agent 3 on the carrier film 4 is recorded as a negative in the sense in which those points at which the coloring agent 3 was transferred to the printable medium 6 allow light to fall into the image sensor 11, these points are therefore detected as bright points, whereas those points at which no transfer of the coloring agent 3 to the printable medium 6 took place block the light from the light source 12 and consequently are recorded as dark points. Consequently, the recorded contrast values correspond to the negative of the previously printed image.

In the case of such an arrangement, it is advisable that both the image sensor 11 and the light source 12 are at a distance from the carrier film 4. In this way, soiling both of the image sensor 11 and of the light source 12 by the carrier film 4 can be avoided.

A further advantage of such an arrangement is that the image sensor 11 is shielded by the carrier film 4 from the medium 6 to be printed and is consequently likewise protected from soiling.

In a further preferred embodiment, the image sensor 11 is a line-scan camera 11*a*.

It is also particularly preferred that the light source 12 comprises light-emitting diodes.

The apparatus 1 for thermal printing or embossing preferably has a traveling device for producing a relative movement between the sensor device 9 and the carrier film 4 on the film conveying section 2.

According to a first preferred variant, the traveling device may in this case be set up for conveying the carrier film 4 past the printhead 7 and the sensor device 9. A means for moving the carrier film 4 along the film conveying section 2 is in any case always necessary, since the carrier film 4 is usually unwound from a strip and has a much greater length in comparison with the dimensions of the apparatus 1. This in any case necessary conveying mechanism is therefore also used in this variant for the purpose of bringing about the relative movement between the sensor device 9 and the carrier film 4 by a movement of the carrier film 4. The line-scan camera 11*a* therefore evaluates the printed image during the transport of the carrier film 4.

It may still further preferably be provided that the carrier film 4 is pressed onto the print support 5 by means of a pressing force exerted from the printhead 7 and that the film conveying section 2 runs such that both the sensor device 9 and a portion of the carrier film 4 that is recorded by the sensor device 9 are at a distance from the print support 5. In this way, the carrier film 4 can be deflected from the contact point between the printhead 7 and the print support 5 to a point at a distance from the print support 5. This provides adequate space for placing the sensor device 9 there.

According to a second preferred variant, the traveling device is set up for the purpose of moving the printhead 7 and the sensor device 9 jointly along the film conveying section 2. There therefore takes place a simultaneously occurring movement of the printhead 7 and the sensor device 9, which are moved along the film conveying section 2. After the completion of the movement of the printhead 7, the carrier film 4 is conveyed further on the film conveying section and the printhead 7 is returned jointly with the sensor device 9, in a way similar to the carriage return on a mechanical typewriter. Here, therefore, the line-scan camera 11*a* is made to travel together with the printhead 7 and the evaluation of the printed image accordingly takes place during this joint movement.

In the case of both variants described here, it may with further preference be provided that the sensor device 9 is set up for the purpose of recording the remaining pattern of the coloring agent 3 on the carrier film during the relative movement between the sensor device 9 and the carrier film 4.

A further teaching of the invention relates to a process for printed image inspection in thermal printing or embossing that comprises the conveying of a carrier film coated with a coloring agent along a section within an apparatus for thermal printing or embossing. The process according to the invention additionally comprises the heating of the carrier film in accordance with a predetermined printed image, so that the coloring agent is transferred from the carrier film to a printable medium in accordance with the predetermined printed image. The process according to the invention also comprises the recording of a remaining pattern of the coloring agent on the carrier film after the heating of the carrier film within the apparatus for thermal printing or embossing and the generation of a sensor signal on the basis of the recorded pattern.

A preferred refinement of this process provides that the heating of the carrier film takes place on the basis of a printed image signal, which corresponds to the predetermined printed image.

Provided with preference as further steps in the process according to the invention are the comparison of the sensor signal with the printed image signal and the generation of a defect detection signal on the basis of the comparison of the sensor signal with the printed image signal.

The invention also relates to a computer program with program code for carrying out all of the process steps of the process according to the invention when the computer program is performed in a computer.

The invention claimed is:

1. An apparatus for thermal printing or embossing, comprising a film conveying section for a carrier film coated with a coloring agent;

a print support for a printable medium, a printhead for selectively heating the carrier film in accordance with a predetermined printed image, so that the coloring agent is transferred from the carrier film to the printable medium in accordance with the predetermined printed image, wherein the apparatus further comprises a sensor device set up for recording a remaining pattern of the coloring agent on the carrier film after the heating of the carrier film and set up for generating a sensor signal on a basis of the recorded pattern, and a logic unit for detecting a defective print on a basis of the sensor signal, preferably on the basis of the sensor signal and a printed image signal, wherein the logic unit is set up for the purpose of detecting on the basis of sensor signal portions on the carrier film on which the coloring agent has remained completely and generating a corresponding print spacing signal.

2. The apparatus as claimed in claim 1, wherein the printhead is a block corresponding to the predetermined printed image for hot embossing.

3. The apparatus as claimed in claim 1, wherein the printhead is a thermal printhead, with heating elements for selectively heating the carrier film on the basis of a printed image signal, which corresponds to the predetermined printed image.

4. The apparatus as claimed in claim 1, wherein the logic unit is set up for the purpose of generating a defect detection signal on the basis of a comparison of the sensor signal and the printed image signal.

5. The apparatus as claimed in claim 4, wherein the logic unit is set up for the purpose of generating a defect detection signal that corresponds to a detected defect when the pattern of the coloring agent recorded by the sensor device, which pattern corresponds to the sensor signal, deviates from a negative of a printed image, which corresponds to the printed image signal.

6. The apparatus as claimed in claim 1, wherein the logic unit is set up for the purpose of determining on the basis of the sensor signal a running-through speed of the carrier film and generating a corresponding speed signal.

7. The apparatus as claimed in claim 1, wherein the sensor device comprises an image sensor and preferably a light source aligned in the direction of the image sensor, the light source being set up for the purpose of illuminating the carrier film such that the remaining pattern of the coloring agent on the carrier film is recorded as a negative by the image sensor.

8. The apparatus as claimed in claim 1, wherein the carrier film is pressed onto the print support by means of a pressing force exerted from the printhead and in that the film conveying section runs such that both the sensor device and a portion of the carrier film that is recorded by the sensor device are at a distance from the print support.

9. The apparatus as claimed in claim 1, wherein the apparatus has a traveling device for producing a relative movement between the sensor device and the carrier film on the film conveying section.

10. The apparatus as claimed in claim 9, wherein the traveling device is set up for the purpose of conveying the carrier film past the printhead and the sensor device.

11. The apparatus as claimed in claim 9, wherein the traveling device is set up for the purpose of moving the printhead and the sensor device jointly along the film conveying section.

12. The apparatus as claimed in claim 9, wherein the sensor device is set up for the purpose of recording the remaining pattern of the coloring agent on the carrier film during the relative movement between the sensor device and the carrier film.

13. An apparatus for thermal printing or embossing, comprising a film conveying section for a carrier film coated with a coloring agent;

a print support for a printable medium, a printhead for selectively heating the carrier film in accordance with a predetermined printed image, so that the coloring agent is transferred from the carrier film to the printable medium in accordance with the predetermined printed image, wherein the apparatus further comprises a sensor device set up for recording a remaining pattern of the coloring agent on the carrier film after the heating of the carrier film and set up for generating a sensor signal on the basis of the recorded pattern, wherein the sensor device comprises an image sensor and preferably a light source aligned in a direction of the image sensor, the light source being set up for a purpose of illuminating the carrier film such that the remaining pattern of the coloring agent on the carrier film is recorded as a negative by the image sensor, and wherein the image sensor is a line-scan camera.

14. An apparatus for thermal printing or embossing, comprising a film conveying section for a carrier film coated with a coloring agent;

a print support for a printable medium, a printhead for selectively heating the carrier film in accordance with a predetermined printed image, so that the coloring agent is transferred from the carrier film to the printable medium in accordance with the predetermined printed image, wherein the apparatus further comprises a sensor device set up for recording a remaining pattern of the coloring agent on the carrier film after the heating of the carrier film and set up for generating a sensor signal on a basis of the recorded pattern, wherein the sensor device comprises an image sensor and preferably a light source aligned in a direction of the image sensor, the light source being set up for the purpose of illuminating the carrier film such that the remaining pattern of the coloring agent on the carrier film is recorded as a negative by the image sensor, and wherein the light source comprises light-emitting diodes.

15. A process for a printed image inspection in thermal printing or embossing, comprising the steps of p1 conveying a carrier film coated with a coloring agent along a section within an apparatus for thermal printing or embossing;

heating the carrier film in accordance with a predetermined printed image, so that the coloring agent is transferred from the carrier film to a printable medium in accordance with the predetermined printed image;

recording a remaining pattern of the coloring agent on the carrier film after the heating of the carrier film within the apparatus for thermal printing or embossing generating a sensor signal on a basis of the remaining pattern, detecting a defective print on a basis of a sensor signal using a logic unit, preferably on the basis of the sensor signal and a printed image signal, wherein the logic unit is set up for a purpose of detecting on a basis of a sensor signal portions on the carrier film on which the coloring agent has remained completely and generating a corresponding print spacing signal.

16. The process as claimed in claim 15, wherein the heating of the carrier film takes place on the basis of a printed image signal, which corresponds to the predetermined printed image.

17. The process as claimed in claim 16, wherein the process comprises the further steps of comparing the sensor signal with the printed image signal and generating a defect detection signal on a basis of a comparison of the sensor signal with the printed image signal.

18. A computer program with program code for carrying out all of the process steps as claimed in claim 15 when the computer program is performed in a computer.

* * * * *